US006335714B1

(12) United States Patent
Wang

(10) Patent No.: US 6,335,714 B1
(45) Date of Patent: Jan. 1, 2002

(54) DISPLAY APPARATUS HAVING A ROTATING DISPLAY PANEL

(75) Inventor: Frank T. Y. Wang, Hsin-Chu (TW)

(73) Assignee: DynaScan Technology Corp., Hsin-Chuang (TW)

( * ) Notice: Subject to any disclaimer, the term of this patent is extended or adjusted under 35 U.S.C. 154(b) by 0 days.

(21) Appl. No.: 09/362,309

(22) Filed: Jul. 28, 1999

(51) Int. Cl.[7] ..... G09G 3/32
(52) U.S. Cl. ..... 345/82; 345/31; 345/84
(58) Field of Search ..... 345/31, 7, 8, 82, 345/83, 840, 84

(56) References Cited

U.S. PATENT DOCUMENTS 4,160,973 A * 7/1979 Berlin, Jr. ..... 340/718
5,050,961 A * 9/1991 Venolia ..... 359/465
5,302,965 A * 4/1994 Belcher et al. ..... 345/31
5,537,144 A * 7/1996 Faris ..... 348/58
5,629,798 A * 5/1997 Gaudreau ..... 359/465
5,717,416 A * 2/1998 Chakrabarti ..... 345/31
5,748,157 A * 5/1998 Eason ..... 345/31
5,818,401 A * 10/1998 Wang ..... 345/31
6,064,423 A * 5/2000 Geng ..... 348/36
6,160,527 A * 12/2000 Morishima et al. ..... 345/7

* cited by examiner

*Primary Examiner*—Dennis-Doon Chow
*Assistant Examiner*—Alecia D. Nelson
(74) *Attorney, Agent, or Firm*—Fei-Fei Chao; Venable, Baetjer, Howard & Civiletti, LLP

(57) ABSTRACT

A display apparatus having a rotating display panel which can generate a three dimensional image when viewed by a viewer wearing polarized glasses is disclosed. The display apparatus comprises a pedestal; a display body rotatably mounted on the pedestal; multiple light emitting arrays, each light emitting array further comprising multiple light emitting units and being equally spaced on a surface of the display body for displaying information when the display body rotates; and a polarizer provided on each of the light emitting arrays, the polarization direction of adjacent polarizers being perpendicular. In addition, the light emitting units are of different to colors whereby the display apparatus having a rotating display panel can generate a colorful image.

5 Claims, 3 Drawing Sheets

DISPLAY APPARATUS HAVING A ROTATING DISPLAY PANEL

BACKGROUND OF THE INVENTION

1. Field of the Invention

The present invention relates to a display apparatus and, more particularly, to a display apparatus having a rotating display panel provided with a polarizer thereon so as to generate a three dimensional (3-D) image that can be viewed by a viewer wearing polarized glasses.

2. Description of Related Art

A conventional electronic display board is composed of a very large number of light emitting units, such as light emitting diodes (LEDs), fluorescent lamps, or liquid crystal displays (LCDs). For example, in the case of a 500×500 pixel display board, if the board operates in a monochromatic display mode, it will require a total amount of 250,000 LEDs. Further, if it displays three colors, the required number of LEDs will be tripled. Obviously, more LEDs will increase the costs of the display board and result in higher maintenance cost.

In order to overcome the aforementioned disadvantages, the same applicant disclosed a display apparatus having a rotating display panel as shown in FIG. 1, which was issued as U.S. Pat. No. 5,818,401 on Oct. 6, 1998. The entire content of that patent is incorporated herein by reference.

Referring to FIG. 1, a conventional display apparatus 100 comprises a pedestal 10, a cylindrical display body 20 rotatably mounted on the pedestal 10 and multiple, vertical, light emitting arrays 11 are secured at equal distances on the wall of the cylindrical body 20. Each of the light emitting arrays 11 is composed of multiple light emitting units such as LEDs. When the display body 20 rotates at a speed that a viewer's eyes cannot distinguish the individual light emitting arrays 11 and the LEDs are sequentially turned on, a viewer sees the corresponding information on the rotating body 20 due to the persistence of vision. In order to achieve a steady picture without flickering, the light emitting arrays 11 and the rotating speed of the display body 20 have to meet certain conditions. In a normal case, the minimum frame rate is 24 frames per second. For this display apparatus 100, the frame rate is the product of the number of light emitting arrays and the rotating speed of the display body. Thus, if there were eight light emitting arrays, the rotational speed of the display body would have to be 3 revolutions or more per second.

Furthermore, as described in U.S. Pat. No. 5,818,401, the rotatable display body of the display apparatus may be configured differently. In a first variant, the light emitting arrays are equally spaced on the outside of a spherical display body, and thus a spherical display panel will be achieved when the display body rotates. In a second variant, the light emitting arrays are placed on a planar surface of a roller body, and each of the arrays is equally spaced radially such that a circular display panel is achieved when the display body rotates.

Although U.S. Pat. No. 5,818,401 provides an improved display apparatus having a rotating display panel so as to generate an image displayed on the rotating display body due to the persistence of vision, the displayed image is simply a plane image, i.e., a two dimensional (2-D) image.

In the past, a three dimensional (3-D) image such as a conventional 3-D movie could be generated on a planar display panel through a specific process based on known optical technologies. Conventionally, polarizers having different polarization directions are provided on the lens of two projectors, respectively. In this arrangement, the images for the left and right eyes of a viewer, differently polarized in two polarization directions, are projected on the screen and reflected to a viewer's eyes, such that the viewer can see the 3-D image through the polarized glasses.

In addition, an optical valve is utilized to synchronously view the left and right images so as to generate an improved 3-D visual effect. However, the glasses formed with the optical valve are expensive and less convenient to use.

SUMMARY OF THE INVENTION

Accordingly, one object of the present invention is to provide a display apparatus having a rotating display panel that can generate a 3-D image when viewed by a viewer wearing polarized glasses.

Another object of the present invention is to provide a display apparatus having a rotating display panel that can generate a colorful image.

A further object of the present invention is to provide a display apparatus having a rotating display panel that reduces the costs of the display panel and the resultant maintenance cost.

A display apparatus comprises a pedestal; a display body rotatably mounted on the pedestal; multiple light emitting arrays, each light emitting array further comprising multiple light emitting units and being equally spaced on a surface of the display body to display information when the display body rotates; and a polarizer on each of the light emitting arrays, the polarization directions of adjacent polarizers being perpendicular.

The polarizers on odd light emitting arrays are horizontally polarized, and the polarizers on even light emitting arrays are vertically polarized.

In accordance with one aspect of the present invention, the display body of the display apparatus is cylindrical, and the light emitting arrays are arranged axially and spaced equally on the wall of the cylindrical display body.

The display body of the display apparatus can be spherical with each of the light emitting arrays equally spaced on the surface of the spherical display body.

The display body of the display apparatus can be a roller body with each of the light emitting arrays equally spaced radially on a planar surface of the roller display body.

Other objects, advantages and features of the invention will become more apparent from the following detailed description when taken in conjunction with the accompanying drawings.

DETAILED DESCRIPTION OF PREFERRED EMBODIMENT

Figure 1:
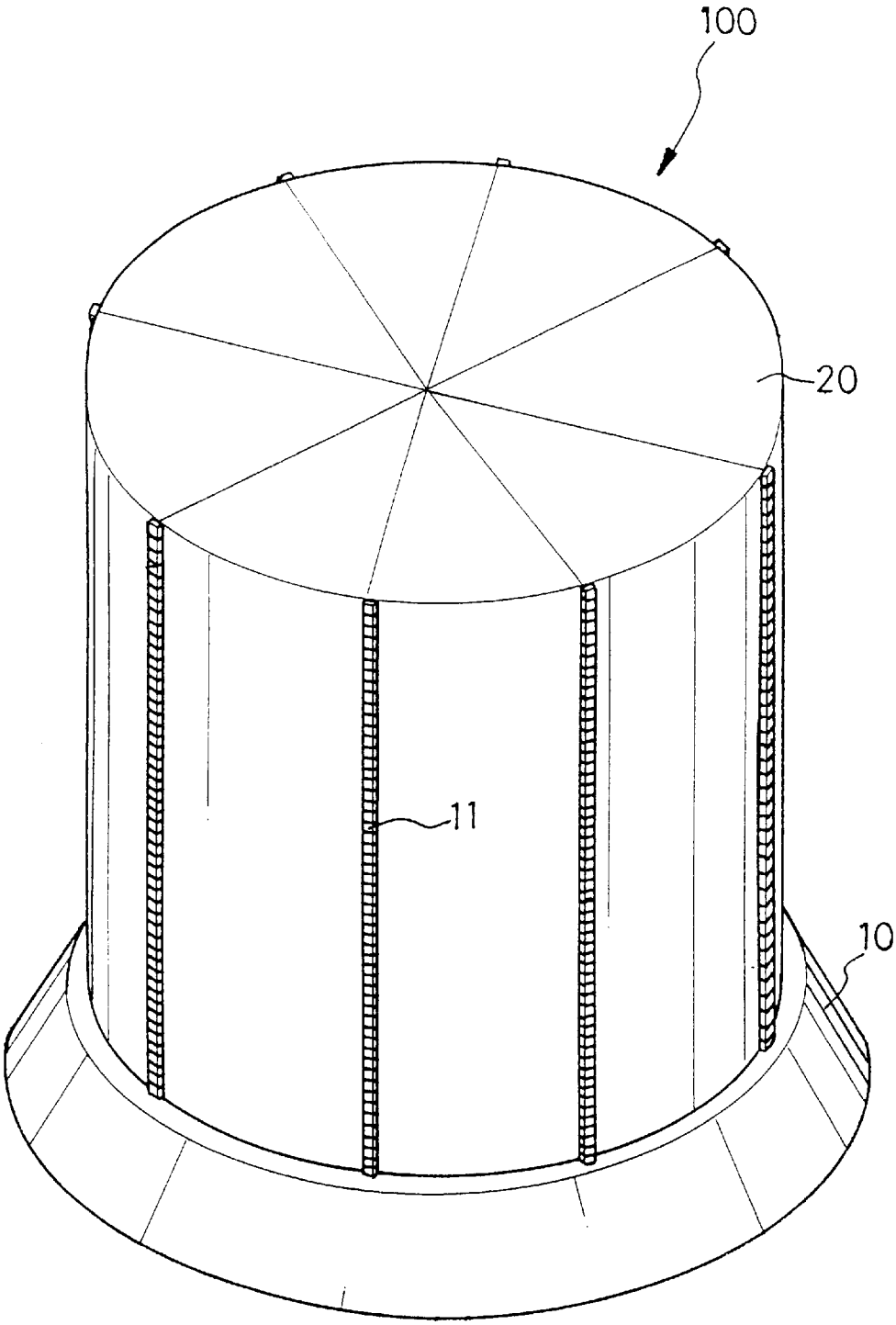
FIG. 1 PRIOR ART
FIG. 1 is a perspective view of a conventional display apparatus having a cylindrical rotating display panel.
Figure 2:
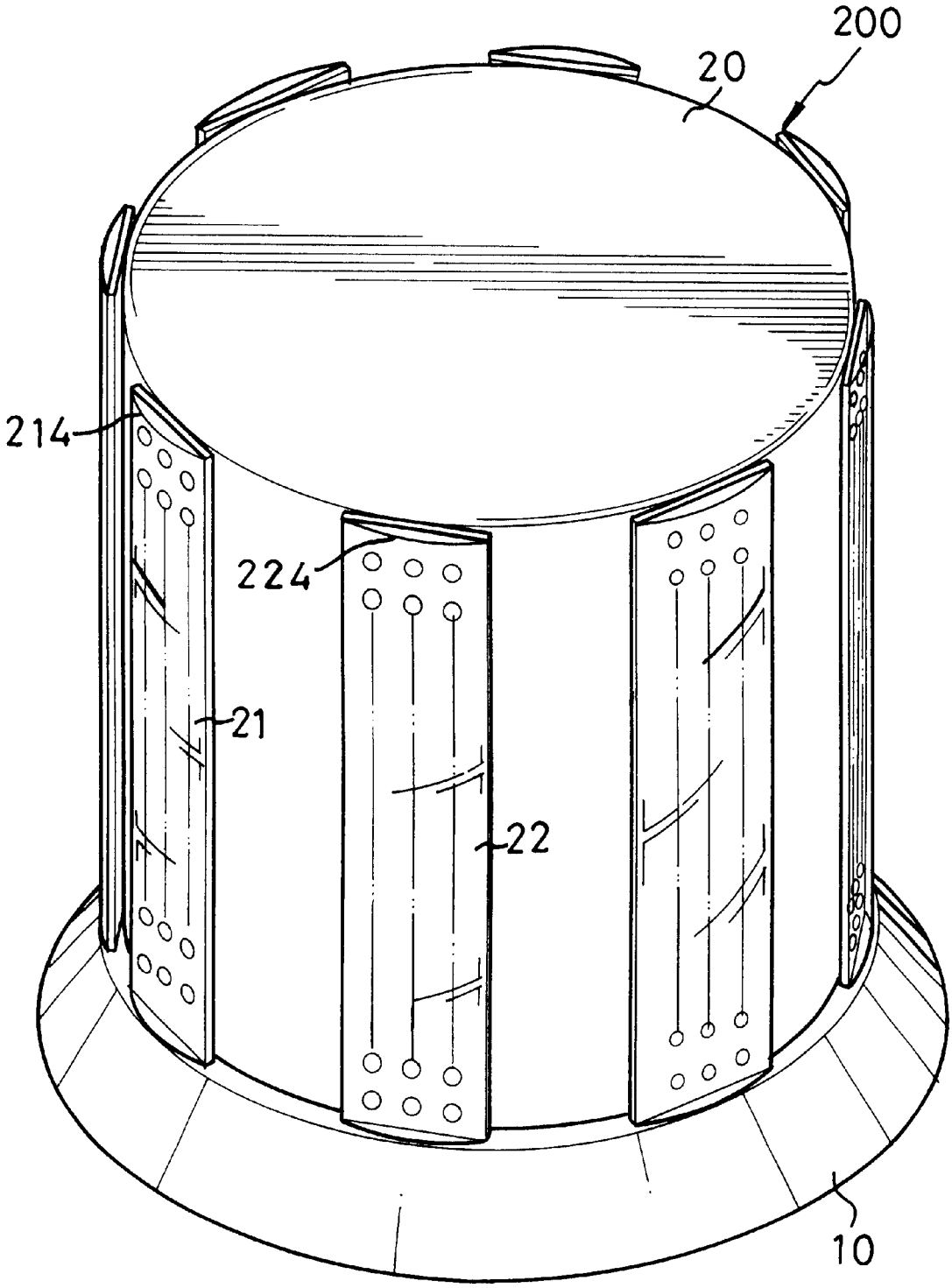
FIG. 2 is a perspective view of a display apparatus having a rotating cylindrical display panel in accordance with the present invention.

Referring to FIG. 2, a display apparatus 200 in accordance with the present invention comprises a pedestal 10, a display body 20 rotatably mounted on the pedestal 10 and multiple light emitting arrays 21–22 each equally spaced on a surface of the display body 20. Each of the light emitting arrays 21–22 is composed of multiple light emitting units, such as light emitting diodes. For simplicity, all the light emitting units are referred as LEDs hereinafter.

The rotatable display body of the display apparatus in accordance with the present invention may be configured in different forms. As shown in FIG. 2, for example, the display body 20 is cylindrical, and each of the light emitting arrays 21–22 is arranged axially and equally spaced on a wall of the cylindrical display body 20. However, the display body may be spherical, in which case each of the light emitting arrays would intersect the poles and be equally separated longitudinally on the outside of the spherical display body. Further, the display body could be a roller body, in which case the light emitting arrays originate at the axis of rotation and are equally spaced radially on a planar surface of the roller display body.

In addition, a control circuit (not shown) is mounted in the display body 20 for controlling the rotation speed of the display body 20 and the information displayed on the display apparatus. Also, a power supply (not shown) having a positive electrode and a negative electrode is mounted within the pedestal 10 to provide the power required by the display apparatus. Since a circuit designer of ordinary skill in the art can easily build the circuits required in the present invention, a description related to both the control circuit and the power supply is omitted.

The operation of the polarizer provided on each of light emitting arrays 21–22 will be described in detail with reference to FIGS. 3 and 4.

Figure 3:
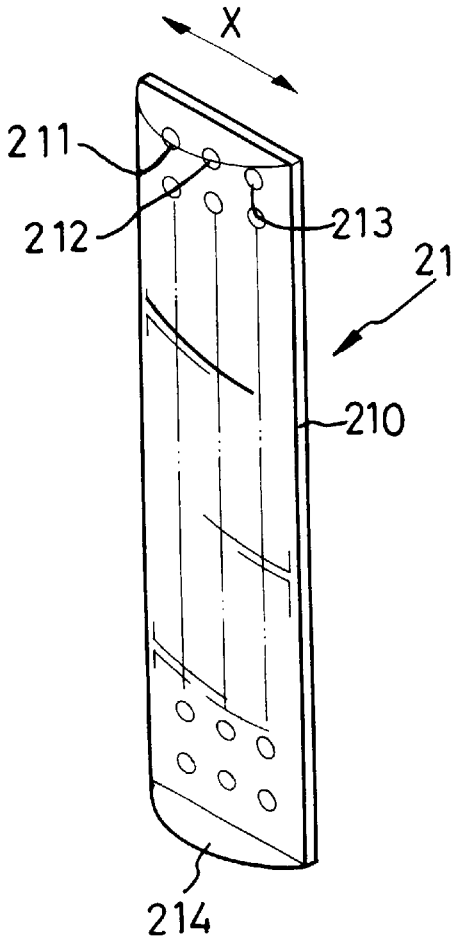
FIG. 3 is a perspective view of a horizontally polarized light emitting array of the display apparatus in FIG. 2.

As shown in FIG. 3, a horizontally polarized light emitting array 21 comprises three sets of LEDs 211, 212 and 213 mounted on a circuit board 210, and each set of LEDs 211, 212 and 213 is composed of multiple LEDs of different colors, respectively. For example, the color of one set of LEDs 211 is red, the color of another set of LEDs 212 is green, and the color of the final set of LEDs 213 is blue. The brightness of the individual LEDs in the sets 211, 212 and 213 is controlled by the control circuit (not shown) utilizing pulse width modulation (PWM), and thus a combined colorful image will be generated and displayed on the rotating display body 20 due to the persistence of vision. More particularly, a first transparent polarizer 214 is provided on the horizontally polarized light emitting array 21. In this embodiment, the polarization direction of the first polarizer 214 on the horizontally polarized light emitting array 21 is in the horizontal direction X.

Figure 4:
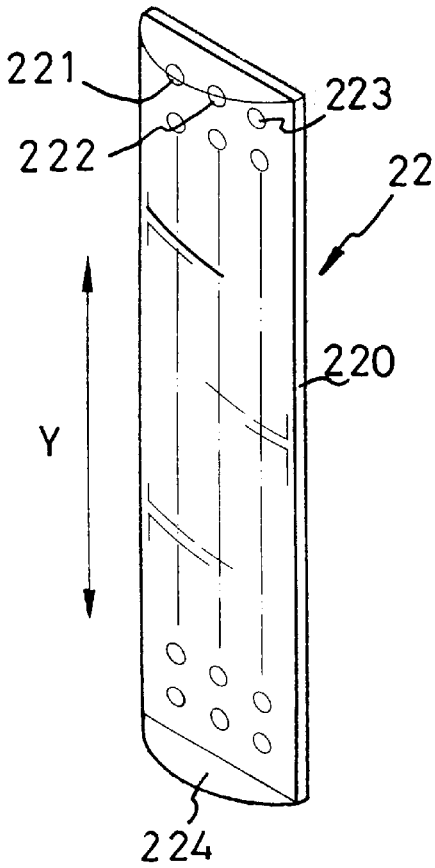
FIG. 4 is a perspective view of a vertically polarized light emitting array of the display apparatus in FIG. 2.

Similarly, as shown in FIG. 4, a vertically polarized light emitting array 22 comprises three sets of LEDs 221, 222 and 223 mounted on a circuit board 220, and each set of LEDs 221, 222 and 223 is composed of multiple LEDs of different colors, respectively. For example, the color of one set of LEDs 221 is red, the color of another set of LEDs 222 is green, and the color of the final set of LEDs 223 is blue. The brightness of the LEDs in each set 221, 222 and 223 is controlled by the control circuit (not shown) utilizing pulse width modulation (PWM), and thus a combined colorful image will be generated and displayed on the rotating display body 20 due to the persistence of vision. More particularly, a second transparent polarizer 224 is provided on the vertically polarized light emitting array 22. In this embodiment, the polarization direction of the second polarizer 224 on the vertically polarized light emitting array 22 is in the vertical direction Y.

Comparing the horizontally polarized light emitting array 21 shown in FIG. 3 with the vertically polarized light emitting array 22 shown in FIG. 4, the only difference between the two is that the first polarizer 214 provided on the light emitting array 21 is horizontally polarized while the vertically polarized polarizer 224 provided on the light emitting array 22 is vertically polarized. That is, the polarization direction of the polarizer 214 provided on the horizontally polarized light emitting array 21 is perpendicular to the polarization direction of the polarizer 224 provided on the horizontally polarized light emitting array 22.

In this manner, the polarization directions of the polarizers on adjacent light emitting arrays are different. More specifically, in this embodiment, each polarizer on an odd numbered light emitting arrays 21 is horizontally polarized, and each polarizer on an even numbered light emitting arrays 22 is vertically polarized.

As the polarization direction of the polarizer provided on each of the odd numbered light emitting arrays 21 is horizontal, the light emitted by each LED of the odd numbered light emitting arrays 21 will be horizontally polarized by the corresponding polarizer provided thereon. Similarly, as the polarization direction of the polarizer provided on each of the even numbered light emitting arrays 22 is vertically polarized, the light emitted by each LED of the even numbered light emitting arrays 22 will be vertically polarized by the corresponding polarizer provided thereon.

As a result, two different polarized images will be generated. More specifically, the odd numbered light emitting arrays 21 will generate horizontally polarized images while the even numbered light emitting arrays 22 will generate vertically polarized images.

If the two different polarized images are at an appropriately different viewing angles with respect to the left and right eyes, the viewer wearing a pair of polarized glasses with the corresponding polarization directions can view the separated left and right image. Thus, the display apparatus in accordance with the present invention can achieve a 3-D visual effect.

In addition, since the left and right images generated by the light emitting arrays 21 and 22 and respectively polarized in two different polarization directions are directly viewed by the viewer, instead of being indirectly reflected to the viewer's eyes, the display apparatus in accordance with the present invention can achieve an improved 3-D visual effect.

It is to be understood, however, that even though numerous characteristics and advantages of the present invention have been set forth in the foregoing description, together with details of the structure and function of the invention, the disclosure is illustrative only, and changes may be made within the principles of the invention to the full extent indicated by the broad general meaning of the terms in which the appended claims are expressed.

What is claimed is:

1. A display apparatus comprising:

a pedestal;

a display body rotatably mounted on said pedestal;

multiple light emitting arrays, each of said light emitting arrays comprising multiple light emitting units and equally spaced on a surface of said display body for displaying information when said display body rotates; and a polarizer provided on each of said light emitting arrays, the polarization direction of adjacent polarizers being perpendicular, wherein said polarizer provided on each odd numbered light emitting array is horizontally polarized, and said polarizer provided on each even numbered light emitting array is vertically polarized.

2. The display apparatus of claim 1, wherein each of said light emitting arrays is composed of multiple light emitting diodes of different colors.

3. The display apparatus of claim 1, wherein said display body is cylindrical, and each of said light emitting arrays is arranged axially and spaced equally on the wall of said cylindrical display body.

4. The display apparatus of claim 1, wherein said display body is a sphere, and each of said light emitting arrays intersects poles of the sphere and is equally separated longitudinally on the outside of said display body.

5. The display apparatus of claim 1, wherein said display body is a roller body, and each of said light emitting arrays originates at the axis of rotation and are equally spaced radially on a planar surface of said roller display body.

* * * * *